United States Patent [19]

Stahle

[11] 4,111,599

[45] Sep. 5, 1978

[54] CENTRIFUGAL PUMP FOR VISCOUS MEDIA

[76] Inventor: Martin Stähle, Postfach 12, 8213 Neunkirch, Switzerland

[21] Appl. No.: 747,497

[22] Filed: Dec. 6, 1976

[51] Int. Cl.[2] ..... F01D 5/00

[52] U.S. Cl. ..... 415/215; 415/73; 415/172 R; 415/213 A; 431/208

[58] Field of Search ..... 415/72–74, 415/121 B, 213 A, 215, 169 A, 170 R, 172 R, 172 A; 416/176; 198/676; 431/208

[56] References Cited

U.S. PATENT DOCUMENTS

| | | | |
|---|---|---|---|
| 2,003,666 | 6/1935 | Moneypenny | 415/215 |
| 3,163,119 | 12/1964 | Huppert et al. | 415/215 |
| 3,442,220 | 5/1969 | Mottram et al. | 415/72 |
| 3,602,604 | 8/1971 | Ronellenfitch | 415/72 |
| 3,771,900 | 11/1973 | Baehr | 416/176 |
| 3,958,723 | 5/1976 | Stähle | 415/215 |

*Primary Examiner*—C. J. Husar
*Attorney, Agent, or Firm*—Lyon & Lyon

[57] ABSTRACT

The present invention is directed to a centrifugal pump of the type including an essentially conical rotor having a helical vane increasing in diameter from its entrance end to its discharge end; the peripheral edge of the vane confronting the wall of the pump housing and forming with the pump housing a discharge or pressure chamber and an intake or suction chamber, the peripheral edge of the vane diverging from the wall of the pump housing from the discharge chamber toward the intake chamber, and having minimal clearance with respect to the wall of the discharge chamber side of the vane.

2 Claims, 2 Drawing Figures

CENTRIFUGAL PUMP FOR VISCOUS MEDIA

BACKGROUND OF THE INVENTION

Centrifugal pumps for viscous fluid, particularly those containing solids, have been used which include an essentially conical rotor having a helical vane increasing diameter from its entrance end to its discharge end, the vane confronting a wall of the pump housing to form with the pump housing an intake or suction chamber, and a discharge or pressure chamber. The peripheral surface of the vane is fitted as close to the pump housing as possible to minimize backflow between the discharge chamber and the intake chamber.

Shearing forces develop in the gap between the peripheral surface of the vane and the pump housing wall, such shearing forces increase with viscosity and also with decrease in the dimensions of the gap and increase in the area of the peripheral surface of the vane. If the viscous material is contaminated with solid particles, such particles tend to accumulate between the peripheral surface of the vane and the confronting wall surface to the extent that rotation may be blocked.

SUMMARY

The primary object of the present invention is to overcome the problem inherent with centrifugal pumps of the type noted; more particularly, the surface of the vane confronting the wall of the pump housing is so arranged as to diverge from the wall in a direction away from the discharge chamber and toward the intake chamber so that only a thin margin of the peripheral vane surface remains in close proximity to the wall. As a result, the quantity of solid particles capable of being received between the thin peripheral margin of the rotor and the confronting wall is minimized, so that the particles quickly pass the thin margin and are carried away by the fluid media which has converged upon and passed between the space between the thin margin and the confronting wall.

DETAILED DESCRIPTION

Figure 1:
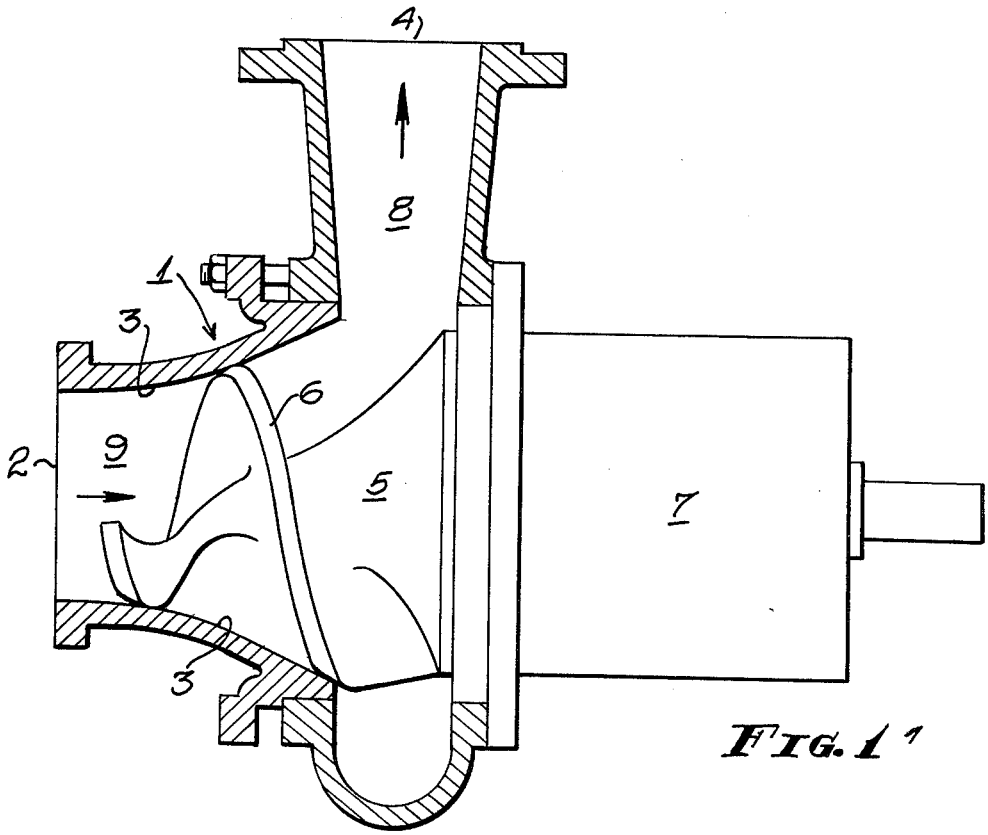
FIG. 1 is a side view of the centrifugal pump with the pump housing in section and the rotor in elevation.
Figure 2:
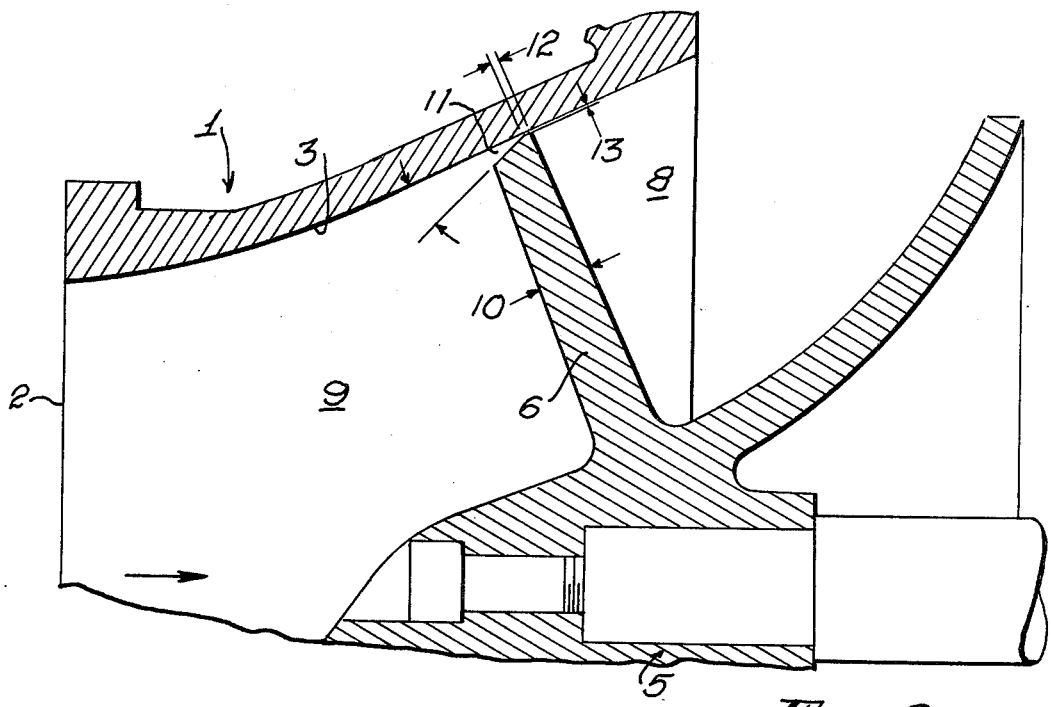
FIG. 2 is an enlarged fragmentary sectional view of the rotor showing particularly the rotor vane and the confronting portion of the pump housing wall.

The pump includes a pump housing 1 having an axially directed inlet 2 forming a pump chamber having diverging walls 3 and a tangental outlet 4.

Fitted within the pump housing is a rotor 5 having one or more vanes 6. The rotor is mounted on a shaft suitably supported by a bearing enclosed in a bearing housing 7.

The construction so far described may be considered as conventional.

The vane 6 divides the pump housing into a discharge or pressure chamber 8 downstream of the vane and an intake or suction chamber 9 upstream of the vane. The thickness 10 of the vane determines a peripheral surface confronting the wall 6 of the housing which includes a major portion 11 diverging toward the intake chamber 9 and a narrow marginal portion 12 spaced from the pump housing wall a minimal distance 13. The diverging portion 11 forms with the pump housing wall an angle within the range between 15° and 40°. While the marginal portion 12 is shown as parallel to the wall surface, the width may be reduced to line; that is, essentially the entire width of the radially outer edge surface of the vane may be tapered.

Operation of the centrifugal pump is as follows:

The marginal portion 12 being narrow minimizes the quantity of solid particles capable of being received between the marginal portion 12 and the confronting wall, and, hence, minimizes the braking effect produced by the particles presented to the marginal portion 12. Because of the narrow dimension of the marginal portion 12, the effective time a particle is presented thereto is minimized. That is, the particles quickly pass the marginal portion 12 and are carried away by the conveyance media entering between the diverging surfaces of the marginal portion 12 and housing wall.

Having fully described my invention, it is to be understood that I am not to be limited to the details herein set forth, but that my invention is of the full scope of the appended claims.

I claim:

1. A centrifugal pump for a viscous conveyance medium containing solid particles comprising:

a. a housing defining a pump chamber having an internal wall defining an intake end and a discharge end;

b. a rotor journalled in the pump chamber and including at least one helical vane having a peripheral surface in confronting relation to the wall of the pump chamber dividing the pump chamber to form at one side of the vane, an intake suction chamber and, at the opposite side of the vane, a discharge pressure chamber;

c. the major portion of the peripheral surface of the vane diverging from the wall of the housing toward the intake suction chamber at an angle of divergence no greater than 40°; and d. the remaining minor portion of the peripheral surface of the vane adjacent the side thereof exposed to the discharge pressure chamber, being in close proximity to the wall of the housing, and the area of said minor portion being such as to minimize the quantity of solid particles capable of being received between said minor portion and the confronting wall, the solid particles on passing said minor portion being transported away from the vane by the conveyance medium entering between said major portion and confronting wall.

2. A centrifugal pump as defined in claim 1, wherein:

a. the diverging major surface occupies essentially the entire width of the vane, reducing the minor portion essentially to a peripheral line.

* * * * *